US009486805B2

(12) United States Patent
Nikolic et al.

(10) Patent No.: US 9,486,805 B2
(45) Date of Patent: Nov. 8, 2016

(54) CRUSHER FEED DISTRIBUTOR

(71) Applicant: SANDVIK INTELLECTUAL PROPERTY AB, Sandviken (SE)

(72) Inventors: Zeljko Nikolic, Svedala (SE); Axel Bergman, Malmo (SE); Mikael M. Larsson, Eslov (SE); Patric Malmqvist, Svedala (SE); Bengt-Arne Eriksson, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/778,067

(22) PCT Filed: Jan. 28, 2014

(86) PCT No.: PCT/EP2014/051598

§ 371 (c)(1),
(2) Date: Sep. 17, 2015

(87) PCT Pub. No.: WO2014/146813

PCT Pub. Date: Sep. 25, 2014

(65) Prior Publication Data

US 2016/0279641 A1 Sep. 29, 2016

(30) Foreign Application Priority Data

Mar. 19, 2013 (EP) ..... 13159975

(51) Int. Cl.
*B02C 2/00* (2006.01)
*B02C 23/02* (2006.01)

(52) U.S. Cl.
CPC ..... *B02C 2/007* (2013.01); *B02C 23/02* (2013.01)

(58) Field of Classification Search
CPC ..... B02C 2/00–2/10; B02C 23/02
USPC ..... 241/207–216, 202, 275
See application file for complete search history.

(56) References Cited

U.S. PATENT DOCUMENTS

| | | | |
|---|---|---|---|
| 1,920,488 | A | 8/1933 | Symons |
| 3,659,691 | A | 5/1972 | Leutelt |
| 8,056,847 | B1 | 11/2011 | Sawant |
| 2010/0108790 | A1 | 5/2010 | Dallimore et al. |

FOREIGN PATENT DOCUMENTS

| | | | |
|---|---|---|---|
| CN | 201192649 | Y | 2/2009 |
| DE | 461068 | C | 6/1928 |
| EP | 1214980 | A1 | 6/2002 |
| FR | 2039161 | A1 | 1/1971 |
| WO | 2004020103 | A1 | 3/2004 |
| WO | 2004110626 | A1 | 12/2004 |
| WO | 2010123431 | A1 | 10/2010 |
| WO | 2012005651 | A1 | 1/2012 |

*Primary Examiner* — Mark Rosenbaum
(74) *Attorney, Agent, or Firm* — Corinne R. Gorski

(57) ABSTRACT

A crusher feed distributor for mounting at a crusher input hopper of a crusher. The feed distributor includes a guide body to contact and distribute the flow of feed material and a mounting assembly to mount the guide body at the input hopper. The mounting assembly is specifically configured with a plurality of independent mounts that collectively provide four adjustments and decrease of freedom corresponding to three lateral adjustments and one rotational adjustment.

14 Claims, 6 Drawing Sheets

CRUSHER FEED DISTRIBUTOR

RELATED APPLICATION DATA

This application is a §371 National Stage Application of PCT International Application No. PCT/EP2014/051598 filed Jan. 28, 2014 claiming priority of EP Application No. 13159975.5, filed Mar. 19, 2013.

FIELD OF INVENTION

The present invention relates to a crusher feed distributor for mounting at a crusher input hopper configured to receive and direct a flow of material to be crushed into the crusher and in particular, although not exclusively, to a distributor having a mounting system with at least three degrees of freedom to optimise alignment with the flow of feed material and the distribution of material into the crusher.

BACKGROUND ART

Gyratory crushers are used for crushing ore, mineral and rock material to smaller sizes. Typically, the crusher comprises a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing gap through which material to be crushed is passed. A driving device positioned at a lower region of the main shaft is configured to rotate an eccentric assembly about the shaft to cause the crushing head to perform a gyratory pendulum movement and crush the material introduced in the crushing gap. Example gyratory crushers are described in WO 2004/110626; WO 2010/123431 and WO 2012/005651.

Similarly, vertical shaft impact crushers (VSI-crushers) are used in many applications for crushing hard material like rocks, ore etc., with examples described in WO 2004/020103 and WO 2010/042025.

Common to the various types of crushers is the need for the controlled feeding of material into the crusher in order to optimise the crushing action and crusher efficiency. Typically, a feed hopper is mounted at the crusher inlet and acts to guide material into the crushing zone. Moreover, a specific feed distributor is mounted with the hopper and acts to receive the flow of material to be crushed and to guide this material through the hopper to provide an even flow into the open upper end of the crusher. Example feed distributors are described in U.S. Pat. No. 1,920,488; FR 2,039,161; EP 1214980; CN 201192649 and U.S. Pat. No. 8,056,847.

Typically, existing feed distributors comprise a guide body having a shelf-like configuration to receive the material flow. The guide body is mounted at an inside region of the hopper walls via a mounting having adjustable components that allow positional adjustment of the guide body according to two degrees of freedom. In particular, the guide body, according to conventional mounting systems, is capable of moving side-to-side within the hopper to change a width of the guide body and to move in an upward and downward direction to change the height of the guide body relative to the hopper and in particular the underlying crusher. However, feed material is usually supplied to the hopper via a conveyor belt system and falls into the hopper as a curtain-like flow. Due to the relatively limited positional adjustment of the guide body, it is a common problem that the distributor is misaligned relative to the curtain of material resulting in non-optimised distribution of feed into the crusher and an unbalancing of the crusher operation which in turn leads to enhanced wear or damage to the crusher components. What is required is a feed distributor that addresses these problems.

SUMMARY OF THE INVENTION

It is an object of the present invention to provide a crusher feed distributor for mounting at a crusher input hopper configured to allow adjustment of the position of the feed distributor relative to the crusher to optimise distribution of feed material to both maximise the crushing efficiency with regard to both crushing reduction and capacity whilst minimising fatigue and stress to the various crushing components of the crusher.

It is a further objective to provide a crusher feed distributor having an enhanced number of degrees of freedom for mounting at the input hopper to optimise alignment of the distributor with respect to the flow of feed material into the crusher.

The objectives are achieved by providing a feed distributor device having a mounting system with at least three mount components that allow the positional adjustment of the distributor relative to the hopper and crusher according to at least three degrees of freedom. In one aspect, the first two degrees of freedom comprise lateral movements of the distributor in a side-to-side and an upward and downward direction relative to the hopper. A third degree of freedom provided by the mounting system may comprise a rotational adjustment of the distributor about an axis extending longitudinally through the hopper and/or a lateral movement in a direction backwards and forwards within the hopper transverse or perpendicular to the side-to-side lateral movement.

The inventors provide a mounting system for a feed distributor in which the distributor comprises a guide body that is suspended via a plurality of independently adjustable mounts, where each mount comprises a separate adjustment component to allow independent positional adjustment of the guide body relative to the hopper and the crusher. In particular, a primary mount type is secured directly to the hopper whilst additional intermediate mount types are suspended from the primary mount type and provide intermediate mountings of the guide body.

In particular, the inventors provide a feed distributor having four degrees of freedom via four adjustable interconnection mounting components that couple the guide body to the hopper and provide adjustment of the guide body in three lateral directions (side-to-side; forward and backward; upward and downwards) and one rotational degree of freedom corresponding to an axis bisecting the distributor centrally and corresponding to a central longitudinal axis of the feed hopper.

According to a first aspect of the present invention there is provided a crusher feed distributor for mounting at a crusher input hopper of a crusher, the distributor comprising: a guide body to receive a flow of material to be crushed and to direct the flow of material into the crusher; a first mount to mount the guide body at a region of the hopper and having a first adjustment component to allow adjustment of the position of the guide body at the hopper along a first pathway such that the guide body is capable of moving in a side-to-side direction within the hopper; a second mount to mount the guide body at a region of the hopper and having a second adjustment component to allow adjustment of the position of the guide body at the hopper along a second pathway such that the guide body is capable of moving in an upward and downward direction within the hopper; characterised by: an additional mount to mount the guide body at a region of the hopper and having an additional adjustment component to provide adjustment of the position of the guide body at the hopper along a third pathway and/or rotation of the guide body about a rotational axis, the third pathway aligned transverse or perpendicular to the first and second pathway to allow the guide body to move in a backwards and forwards direction within the hopper and/or rotation about a longitudinal axis extending through the hopper.

Preferably, the additional mount comprises a fourth mount having a fourth adjustment component configured to provide rotational movement of the guide body about an axis corresponding to a longitudinal axis of the hopper to allow rotational mounting adjustment of the guide body within the hopper.

Optionally, the additional mount comprising a third mount having a third adjustment component configured to allow adjustment of the position of the guide body at the hopper along a third pathway aligned perpendicular or transverse to the first and second pathway such that the guide body is capable of moving in the backward and forward direction within the hopper.

Optionally, the third and fourth adjustment components comprise an elongate slot formed in the respective third and fourth mount, the third and fourth mount further comprising a respective attachment member to slide within the respective elongate slot of the third and fourth mount.

Optionally, the guide body comprises a first shelf and a second shelf independently mounted and adjustable at the hopper.

Optionally, the third mount comprises a pair of elongate brackets, each bracket comprising a respective elongate slot to receive a respective attachment member to slide within the slot. Optionally, the fourth mount member comprises a pair of brackets each having an elongate slot to receive an attachment element to slide within the slot, each bracket of the fourth mount configured for attachment to an upper region of the hopper. Optionally, the first mount comprises a pair of elongate brackets, each bracket comprising an elongate slot to receive an attachment element to slide within the respective slot.

Optionally, the second mount comprises a beam slideably mounted at the pair of elongate brackets of the third mount, wherein end regions of the beam are respectively mounted at a region a bracket that in part defines the fourth mount having an elongate slot to receive an attachment element that attaches the end regions of the beam to each respective bracket to allow the beam to slide in the upward and downward direction at the hopper.

Preferably, the guide body is mounted at the input hopper via the fourth mount and wherein the first, second and third mounts are suspended between the fourth mount and the guide body.

Optionally, each bracket of the first mount is fixed rigidly to a respective bracket of the third mount such that the brackets of the first mount extend substantially perpendicular or transverse to the brackets of the third mount.

Optionally, the first and second shelf each comprise a mount region having an attachment element to be received within each respective elongate slot of each respective bracket of the first mount to allow each shelf to slide in the side-to-side direction within the hopper along each bracket of the first mount.

According to a second aspect of the present invention there is provided a crusher input hopper comprising a feed distributor as claimed herein.

According to a third aspect of the present invention there is provided a gyratory crusher comprising a feed hopper as claimed herein.

DETAILED DESCRIPTION OF THE DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
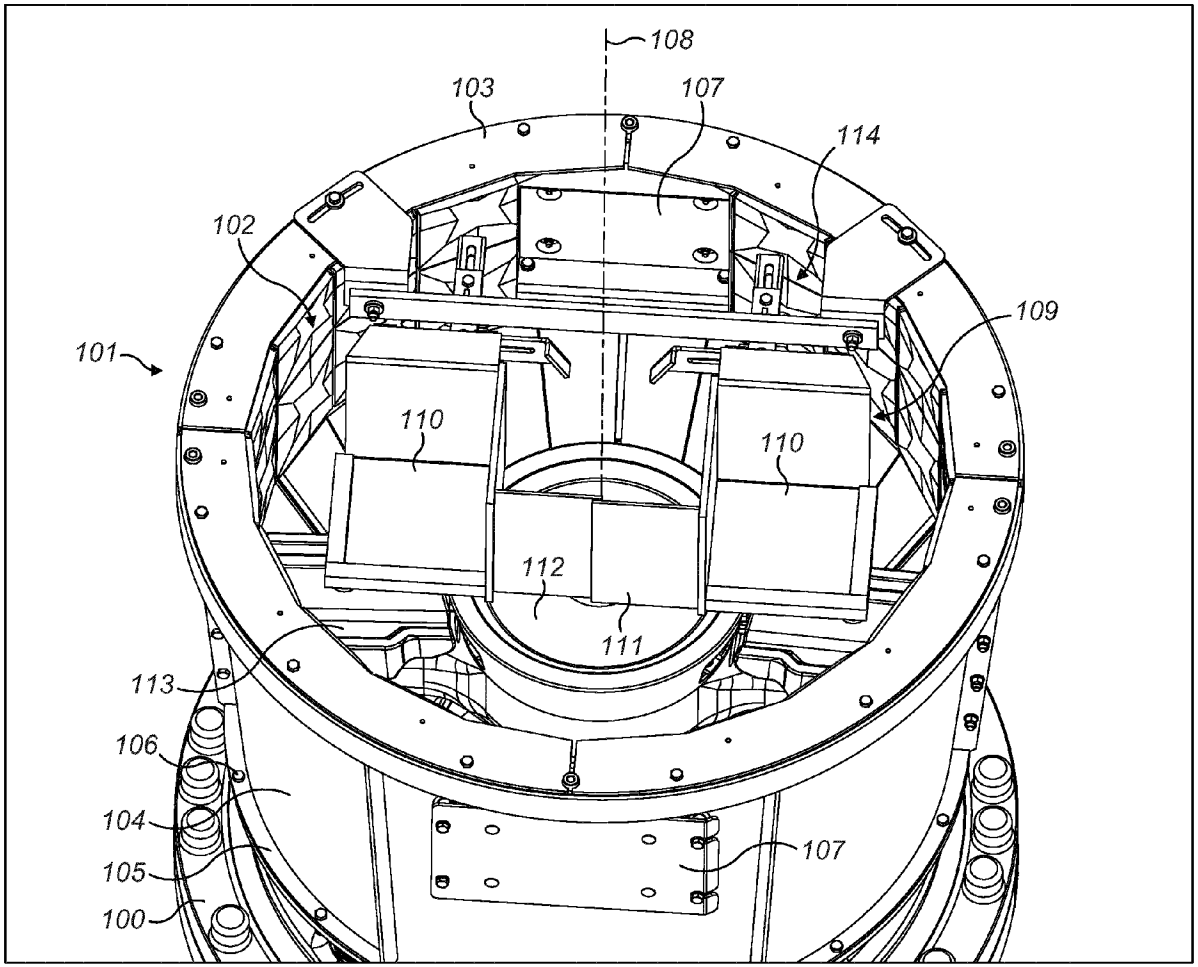
FIG. 1 is an upper external perspective view of a feed hopper mounted upon a crusher having a feed distributor positioned within the hopper via a mounting apparatus having four degrees of freedom according to a specific implementation of the present invention.

Referring to FIGS. 1 to 6, a gyratory crusher 100 comprises a feed input hopper 101 having a main hopper side wall 104 that extends circumstantially around a central longitudinal axis 108 of hopper 101. Wall 104 extends between an uppermost end that terminates at an annular rim 103 and a lowermost end that also terminates at a lower annular rim 105 suitable for mounting upon crusher 100. Accordingly, uppermost rim 103 is positioned furthest from crusher 100. Hopper 101 is mounted at crusher 100, or an intermediate component port, via mounting bolts 106 that extends through lower rim 105. Wall 104 defines an internal hopper chamber 102 extending between uppermost and lowermost rims 103, 105. To allow access into chamber 102, a pair of hatches having a frame and door 107 are mounted at respective diametrically opposed regions of wall 104. As illustrated, rim 103 projects radially outward from wall 104 and extends substantially perpendicular to axis 108. To assist with the guiding of a flow of feed material into crusher 100, a feed distributor 109 is positioned within hopper chamber 102 and within the region defined by wall 104. Distributor 109 is positioned directly above a spider cap 112 positioned at axis 108 that provides a protective cover for a spider boss (not shown) from which extend two diametrically opposed spider arms (not shown) in turn protected by arm shields 113.

Feed distributor 109 is mounted at hopper 101 via a mount assembly 114 that provides an adjustable coupling between a guide body 110 and a mounting region located at upper annular rim 103 of hopper 101.

Figure 2:
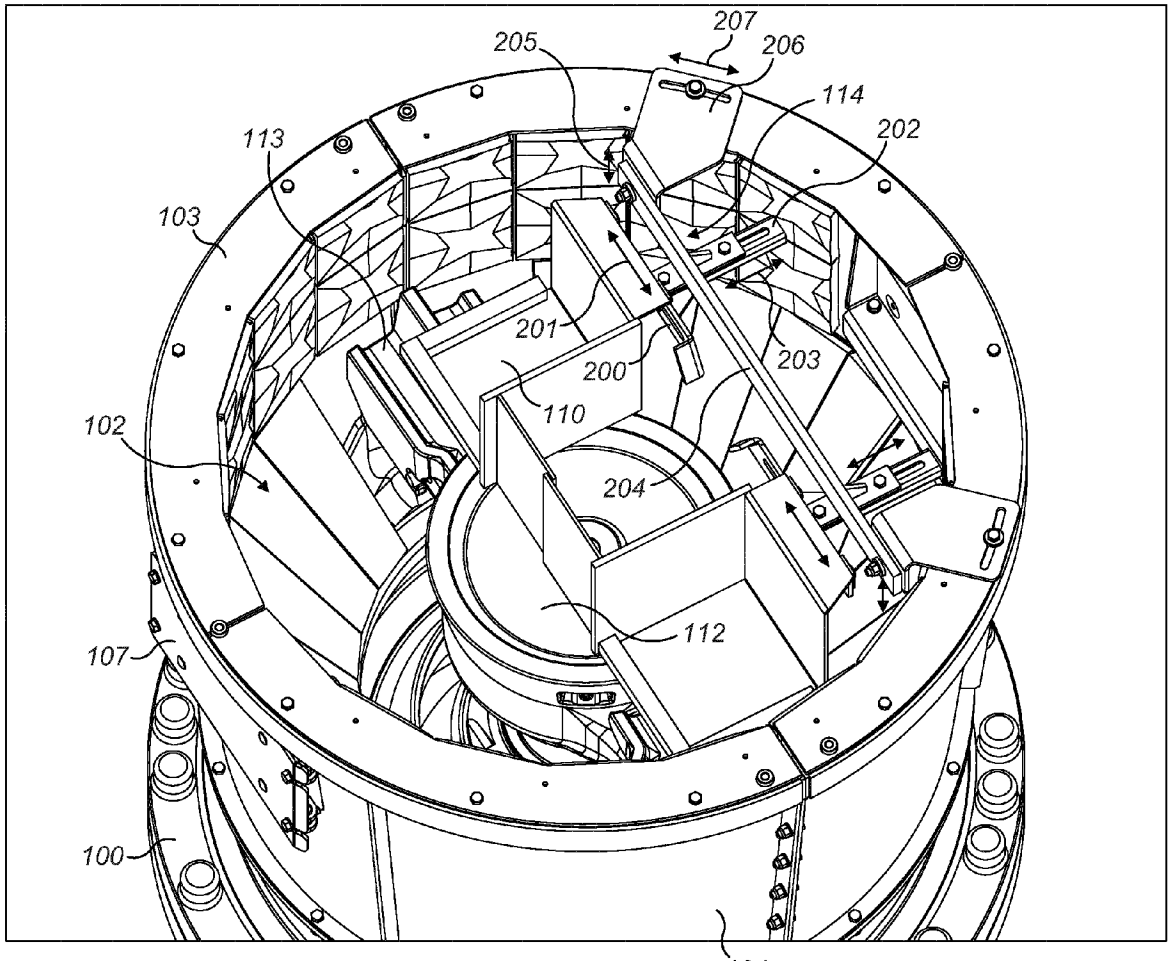
FIG. 2 is a further external upper perspective view of the feed distributor of FIG. 1.
Figure 3:
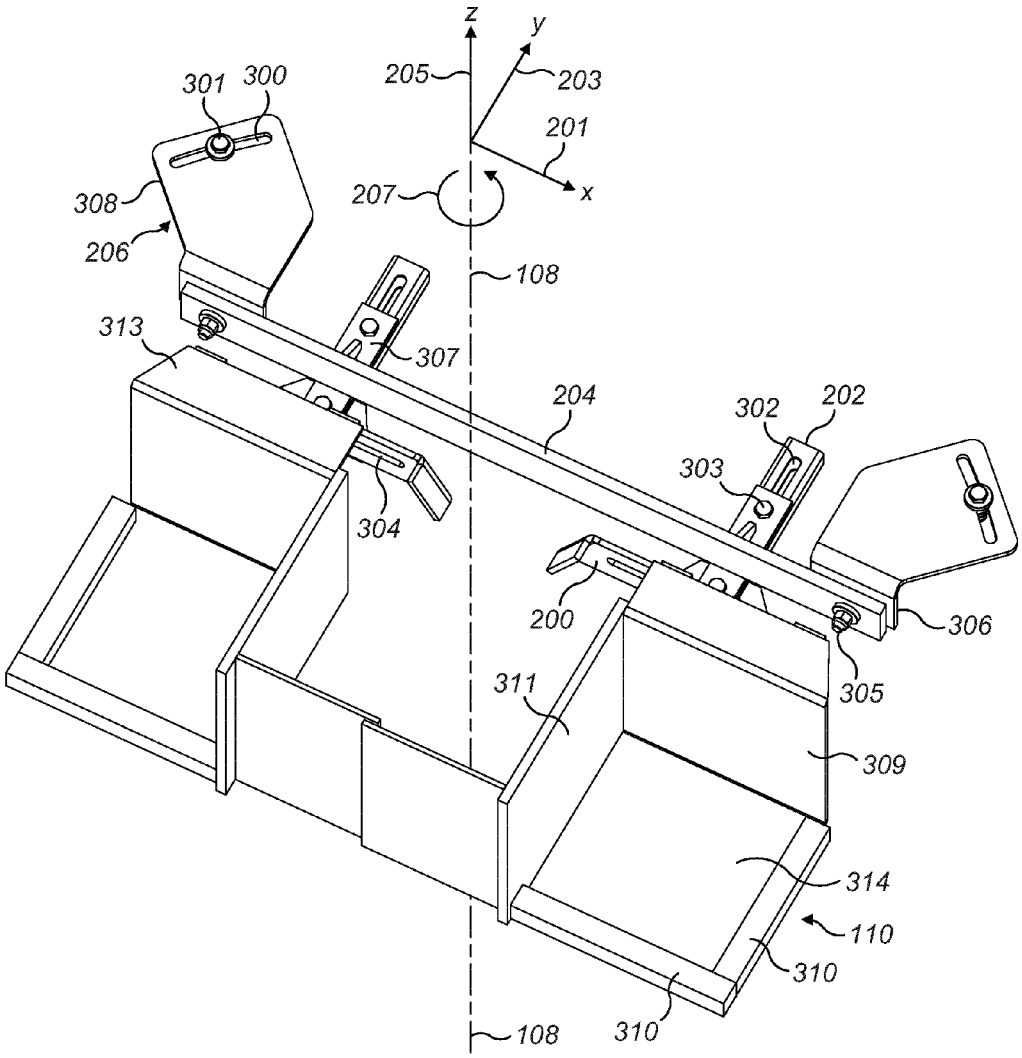
FIG. 3 is a front upper perspective view of the feed distributor of FIG. 2 shown isolated from the feed hopper.
Figure 4:
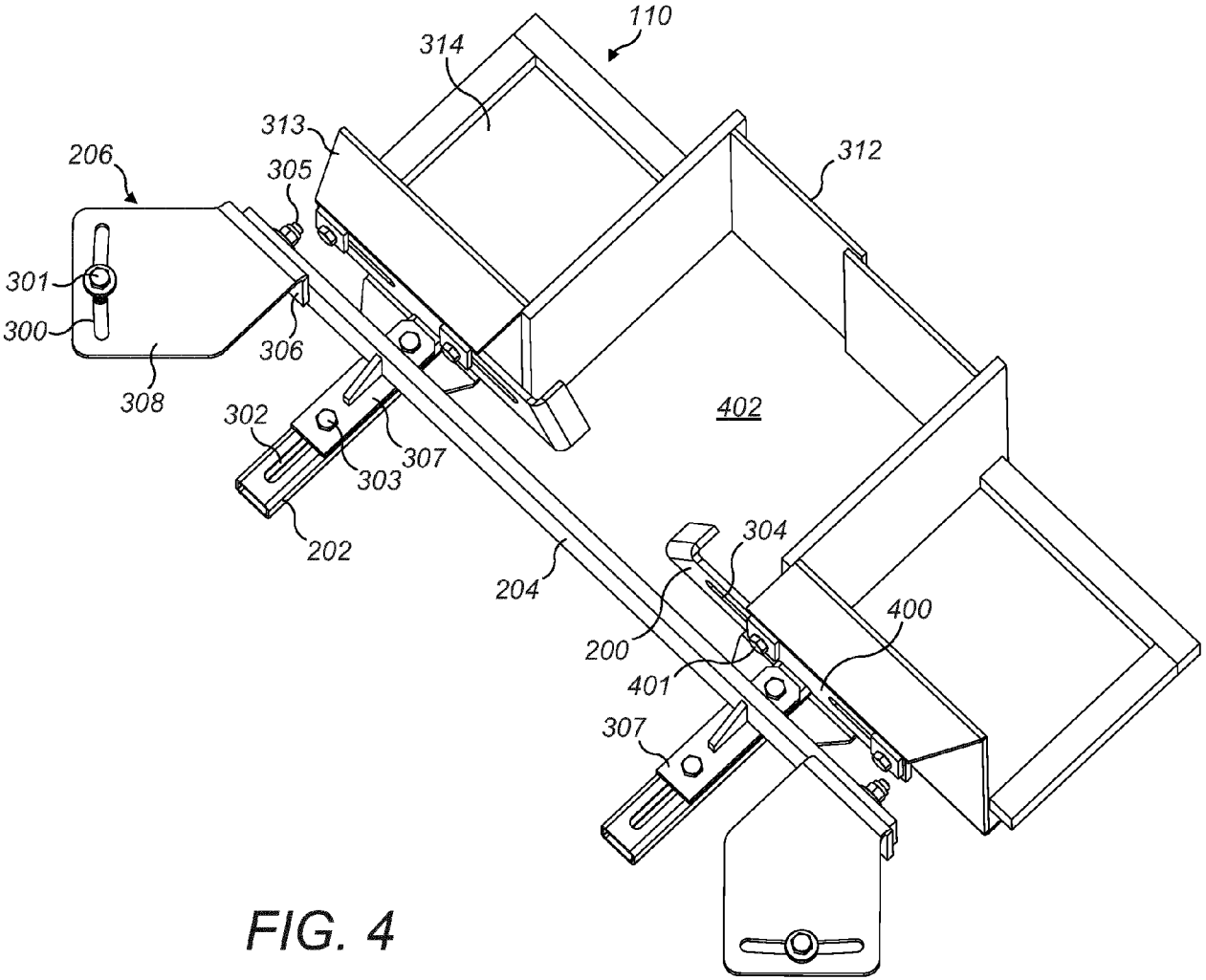
FIG. 4 is a first rear upper perspective view of the feed distributor of FIG. 3 isolated from the hopper of FIG. 2.
Figure 5:
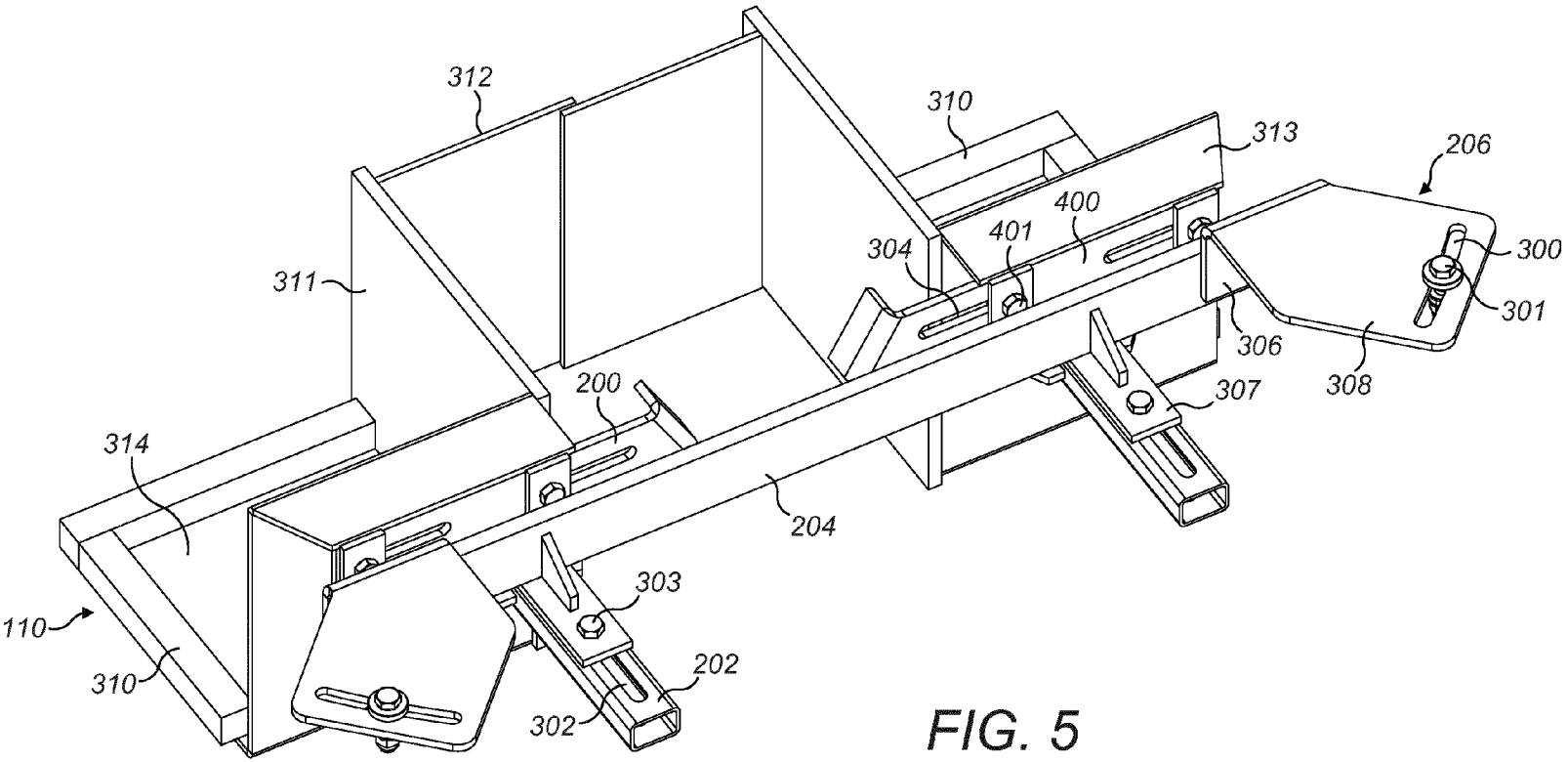
FIG. 5 is a second rear upper perspective view of the feed distributor of FIG. 4 isolated from the hopper of FIG. 2.
Figure 6:
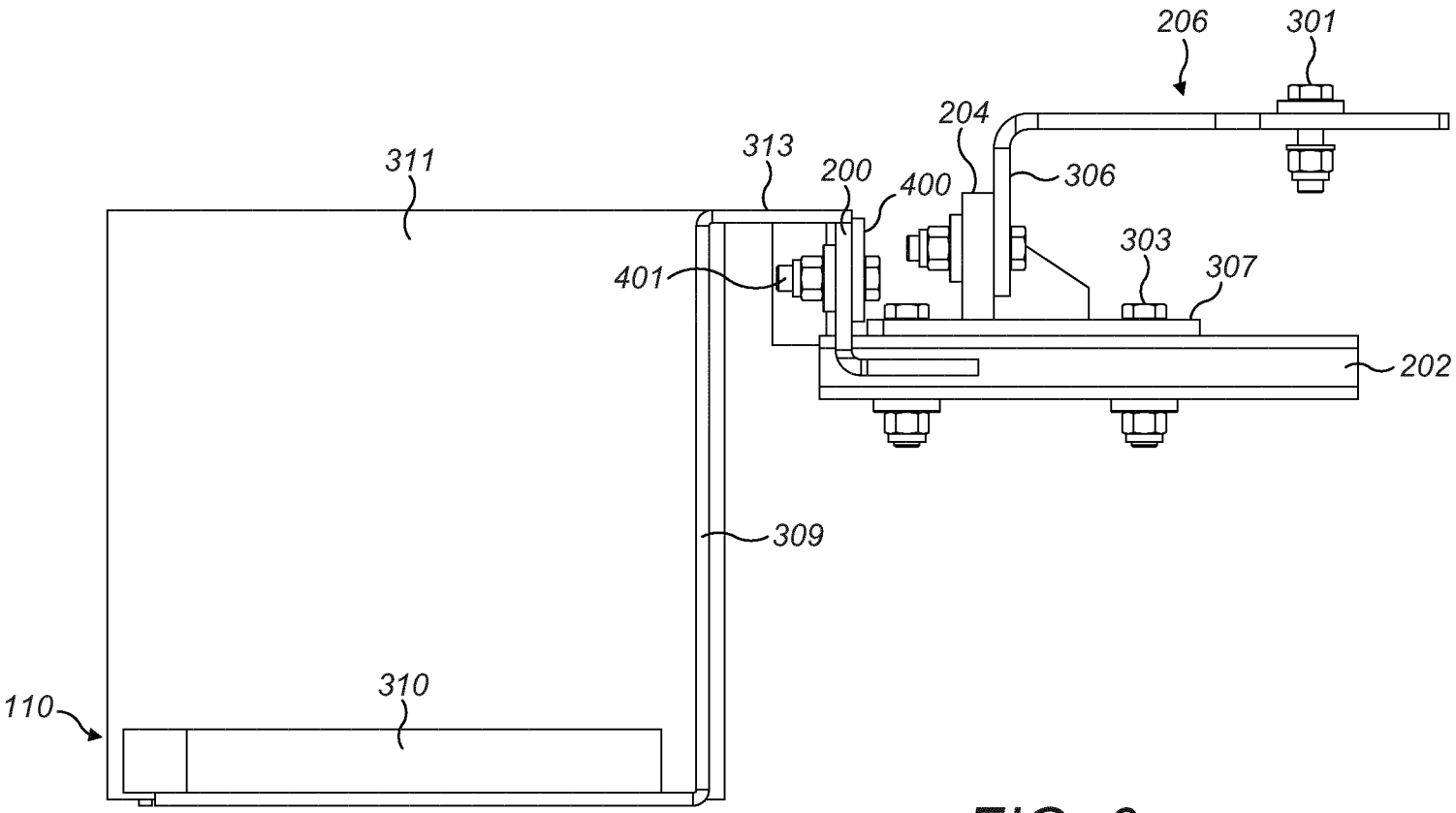
FIG. 6 is a side view of the feed distributor of FIG. 5 isolated from the hopper of FIG. 2.

Mount assembly 114 comprises a plurality of mounts, where each mount comprising an adjustment component to allow the positional adjustment of guide body 110 within hopper 101. Referring to FIGS. 2 to 4, guide body 110 comprises a pair of laterally separated seat-shaped bodies, each seat comprises a substantially horizontal shelf plate 314. A rear plate 309 extends upwardly from one edge of square shelf 314 and a side plate 311 extends upwardly from an adjacent side of shelf 314. A flange gate 312 extends laterally from one edge of plate 311 at an opposite side to shelf 314. Gate 312 like plate 311 and 309 is aligned perpendicular to shelf 314. That is, relative to axis 108, shelf 314 extends in the X-Y coordinates whilst plates 309, 311 and gate 312 extend in the X-Z and Y-Z coordinates. A lip 310 extends along the remaining two edges of shelf 314 so as to project a short distance vertically upward from an upper facing surface of shelf 314. Each shelf 314 of guide body 110 is spaced apart in the X coordinate to create a gap region 402 between opposed plates 311. Gates 312 of each respective seat are orientated towards one another but are off-set in the Y coordinate so as to be capable of overlapping and sliding past one another when each seat is adjusted laterally in the X coordinate via the mounting assembly 114.

Referring to FIGS. 2 to 6, mounting assembly 114 comprises a first elongate bracket 200 having an elongate slot 304 extending between respective ends of bracket 200. A third mount is also formed as an elongate third bracket 202 having an elongate slot 302 extending between its respective two ends. Third bracket 202 is rigidly connected to first bracket 200 at an approximate mid-length region of bracket 200 and via one end region of third bracket 202 to form a T-shaped structure when viewed in plan. That is, first bracket 200 extends in the X coordinate and third bracket 202 extends in the Y coordinate. Assembly 114 further comprises a second mount having an elongate beam 204 extending in the X coordinate and rigidly attached to a bar 307 extending perpendicular to beam 204 in the Y coordinate. Second mount further comprises a region 306 of a bracket 206, where a further region 308 of bracket 206 is intended for attachment at the upper rim 103 of hopper 101. Region 306 extends in the Z coordinate and also comprises an elongate slot (not shown) aligned with longitudinal axis 108. Further region 308 of bracket 206 extends perpendicular to region 306 and in the X-Y plane. Second region 308 also comprises an elongate slot 300. Accordingly, region 306 may be considered a second bracket (or a part of the second mount) and region 308 may be considered a fourth bracket (or a part of the fourth mount).

According to the specific embodiment, each individual seat of guide body 110 is independently mounted via respective and separate first and third mount brackets 200 and 202 positioned side-by-side and extending rearwardly from rear plate 309 of each seat. In particular, rear plate 309 is terminated at its uppermost end by a flange 313 that comprises a mount portion 400 through which extend a pair of mounting bolts 401 extending through elongate slot 304 so as to attach the respective seat of guide body 110 to first mount 200. Each of the third mounting brackets 202 provides a support and mount for beam 204 that comprises a pair of spaced apart bars 307. A plurality of mounting bolts 303 connect each bar 307 to a respective third bracket 202 via mounting within elongate slot 302. Each respective end of beam 204 is mounted at a respective second mount region 306 of bracket 206 via attachment of engaging bolts 305 through the elongate slots (not shown) that extend through each region 306. The entire mounting assembly 114 and guide body 110 are suspended from hopper 101 via upper rim 103 and the pair of third brackets (regions 308) and in particular the respective mounting bolts 301 that extend through each respective elongate slot 300 and are received and secured to upper rim 103.

Accordingly, each seat of guide body 110 is capable of moving in a first lateral direction 201 in the X coordinate extending perpendicular to axis 108 via sliding adjustment of each mounting bolt 401 within elongate slot 304 of the pair of first brackets 200 to define first mount.

Each seat of guide body 110 is also configured to move in a third lateral direction corresponding to a forward and rearward motion 203 (to and from each respective hatch and door 107) along Y coordinate also aligned perpendicular to axis 108. The Y coordinate adjustment 203 is provided by sliding movement of each mounting bolt 303 within the pair of respective parallel elongate slots 302 respectively formed within each third mounting bracket 202 extending in the Y coordinate.

The second mount encompassing beam 204 and bracket portion 306 and is configured to allow adjustment of guide body 110 in the Z coordinate corresponding to an upward and downward movement 205 aligned substantially parallel within axis 108. This is achieved in particular via sliding adjustment of each mounting bolt 305 within elongate slot (not shown) of bracket portion 306. Accordingly, guide body and in particular each respective seat is capable of adjustment in the X, Y and Z coordinates in directions 201, 203 and 205 via the respective first, second and third mounts of assembly 114.

A fourth mounting degree of freedom is provided by second region 308 of bracket 206. That is, the entire guide body 110 and mounting assembly 114 may be rotated in a direction 207 about axis 108 (corresponding to Z coordinate 205) by sliding adjustment of each mounting bolt 301 within each elongate slot 300 of bracket 206.

In use, a flow of crushable feed material is dropped vertically on to guide body 110 to contact shelves 314. Following continuous feed supply, a respective pile of material is created above shelf 314 via lips 310 such that each seat of guide body 110 is effectively self-protecting via the piles of material. A corresponding sloping pile of feed material is accumulated at the gap region 402 above the spider cap 112 and is supported by the side-by-side extending gates 312. Accordingly, the feed distributor is configured to split the flow of feed in the X coordinate such that the material falling in to gap region 402 flows rearwardly in the Y coordinate and the flow of material contacting shelves 314 is directed forwardly in the Y coordinate.

During initially set-up of the feed supply, or following a period of supply, the position of guide body 110 within hopper 101 may be adjusted via any one of the independent four degrees of freedom provided by assembly 114 to optimise the distribution of feed to crusher 100. That is, each seat of guide body 110 may be manipulated in directions 201, 203, 205 and 207 corresponding to the three lateral adjustments and the single rotational adjustment. This is advantageous over conventional feed distributors where the entire hopper and crusher are in some instances rotated about axis 108 so as to better align within the supply of feed material. The present feed distributor may be positionally adjusted conveniently via independent adjustment of any one or set of mounting bolts 401, 303, 305 and 301 of mount assembly 114.

The invention claimed is:

1. A crusher feed distributor for mounting at a crusher input hopper of a crusher, the distributor comprising:

a guide body to receive a flow of material to be crushed and to direct the flow of material into the crusher;

a first mount to mount the guide body at a region of the hopper and having a first adjustment component to allow adjustment of the position of the guide body at the hopper along a first pathway such that the guide body is capable of moving in a side-to-side direction within the hopper;

a second mount to mount the guide body at a region of the hopper and having a second adjustment component to allow adjustment of the position of the guide body at the hopper along a second pathway such that the guide body is capable of moving in an upward and downward direction within the hopper; and an additional mount to mount the guide body at a region of the hopper and having an additional adjustment component to provide adjustment of the position of the guide body at the hopper along a third pathway and/or rotation of the guide body about a rotational axis, the third pathway being aligned transverse or perpendicular to the first and second pathway to allow the guide body to move in a backwards and forwards direction within the hopper and/or rotation about a longitudinal axis extending through the hopper.

2. The feed distributor as claimed in claim 1, wherein the additional mount includes a third mount having a third adjustment component configured to allow adjustment of the position of the guide body at the hop along a third pathway aligned perpendicular or transverse to the first and second pathway such that the guide body is capable of moving in the backward and forward direction within the hopper.

3. The feed distributor as claimed in claim 2, wherein the additional mount includes a fourth mount having a fourth adjustment component configured to provide rotational movement of the position of the guide body about an axis corresponding to a longitudinal axis of the hopper to allow rotational mounting adjustment of the guide body within the hopper.

4. The feed distributor as claimed in claim 3, wherein the third and fourth adjustment components include an elongate slot formed in the respective third and fourth mount, the third and fourth mount further having a respective attachment member to slide within the respective elongate slot of the third and fourth mount.

5. The feed distributor as claimed in claim 4, wherein the guide body includes a first shelf and a second shelf independently mounted and adjustable at the hopper.

6. The feed distributor as claimed in claim 5, wherein the third mount includes a pair of elongate brackets, each bracket having a respective elongate slot to receive a respective attachment member to slide within the slot.

7. The feed distributor as claimed in claim 6, wherein the fourth mount includes a pair of brackets each having an elongate slot receive an attachment element to slide within the slot each bracket of the fourth mount being configured for attachment to an upper region of the hopper.

8. The feed distributor as claimed in claim 7, wherein the first mount includes a pair of elongate brackets, each bracket having an elongate slot to receive an attachment element to slide within the respective slot.

9. The feed distributor as claimed in claim 8, wherein each bracket of the first mount is fixed rigidly to a respective bracket of the third mount such that the brackets of the first mount extends substantially perpendicular or transverse to the brackets of the third mount.

10. The feed distributor as claimed in claim 8, wherein the first and second shelf each include a mount region having an attachment element received within each respective elongate slot of each respective bracket of the first mount to allow each shelf to slide in the side-to-side direction within the hopper along each bracket of the first mount.

11. The feed distributor as claimed in claim 7, wherein the second mount includes a beam slideably mounted at the pair of elongate brackets of the third mount, the end regions of the beam being respectively mounted at a region of the bracket having an elongate slot to receive an attachment element that attaches the end regions of the beam to each respective bracket to allow the beam to slide in the upward and downward direction at the hopper.

12. The feed distributor as claimed in claim 3, wherein the guide body is mounted at the input hopper via the fourth mount and wherein the first, second and third mounts are suspended between the fourth mount and the guide body.

13. A crusher input hopper of a crusher comprising a feed distributor, the feed distributor including a guide body to receive a flow of material to be crushed and to direct the flow of material into the crusher;

a first mount to mount the guide body at a region of the hopper and having a first adjustment component to allow adjustment of the position of the guide body at the hopper along a first pathway such that the guide body is capable of moving in a side-to-side direction within the hopper;

a second mount to mount the guide body at a region of the hopper and having a second adjustment component to allow adjustment of the position of the guide body at the hopper along a second pathway such that the guide body is capable of moving in an upward and downward direction within the hopper; and an additional mount to mount the guide body at a region of the hopper and having an additional adjustment component to provide adjustment of the position of the guide body at the hopper along a third pathway and/or rotation of the guide body about a rotational axis, the third pathway being aligned transverse or perpendicular to the first and second pathway to allow the guide body to move in a backwards and forwards direction within the hopper and/or rotation about a longitudinal axis extending through the hopper.

14. A gyratory crusher comprising:

a feed hopper; and a crusher feed distributor mounted at the feed hopper, the feed distributor including a guide body to receive a flow of material to be crushed and to direct the flow of material into the crusher;

a first mount to mount the guide body at a region of the hopper and having a first adjustment component to allow adjustment of the position of the guide body at the hopper along a first pathway such that the guide body is capable of moving in a side-to-side direction within the hopper;

a second mount to mount the guide body at a region of the hopper and having a second adjustment component to allow adjustment of the position of the guide body at the hopper along a second pathway such that the guide body is capable of moving in an upward and downward direction within the hopper; and an additional mount to mount the guide body at a region of the hopper and having an additional adjustment component to provide adjustment of the position of the guide body at the hopper along a third pathway and/or rotation of the guide body about a rotational axis, the third pathway being aligned transverse or perpendicular to the first and second pathway to allow the guide body to move in a backwards and forwards direction within the hopper and/or rotation about a longitudinal axis extending through the hopper.

* * * * *